US006700562B1

(12) United States Patent
Knapp et al.

(10) Patent No.: US 6,700,562 B1
(45) Date of Patent: Mar. 2, 2004

(54) ACTIVE MATRIX LIQUID CRYSTAL DISPLAY DEVICES

(75) Inventors: Alan G. Knapp, Crawley (GB); Martin J. Edwards, Crawley (GB)

(73) Assignee: Koninklijke Philips Electronics N.V, Eindhoven (NL)

( * ) Notice: Subject to any disclaimer, the term of this patent is extended or adjusted under 35 U.S.C. 154(b) by 0 days.

(21) Appl. No.: 09/464,869

(22) Filed: Dec. 16, 1999

(30) Foreign Application Priority Data

Dec. 19, 1998 (GB) ..... 9827988

(51) Int. Cl.[7] ..... G09G 3/36

(52) U.S. Cl. ..... 345/98; 345/90; 345/103; 349/41; 349/151

(58) Field of Search ..... 345/87, 92, 90, 345/98, 100, 103, 208, 214; 349/41, 138, 149, 151

(56) References Cited

U.S. PATENT DOCUMENTS

| | | | | |
|---|---|---|---|---|
| 4,714,921 A | * | 12/1987 | Kanno et al. | 345/100 |
| 4,890,101 A | | 12/1989 | Carlson | 340/811 |
| 5,130,829 A | | 7/1992 | Shannon | 359/59 |
| 5,510,807 A | * | 4/1996 | Lee et al. | 345/103 |
| 5,641,974 A | | 6/1997 | den Boer et al. | 257/59 |
| 5,648,793 A | * | 7/1997 | Chen | 345/96 |
| 5,686,936 A | * | 11/1997 | Maekawa et al. | 345/100 |
| 5,764,207 A | * | 6/1998 | Maekawa et al. | 345/100 |
| 5,892,493 A | * | 4/1999 | Enami et al. | 345/94 |
| 5,959,600 A | * | 9/1999 | Uchino et al. | 345/94 |
| 6,163,310 A | * | 12/2000 | Jinno et al. | 345/87 |
| 6,452,580 B1 | * | 9/2002 | Edwards et al. | 345/100 |
| 2001/0010511 A1 | * | 8/2001 | Uchino et al. | |

FOREIGN PATENT DOCUMENTS

| | | | |
|---|---|---|---|
| EP | 0617310 A1 | 9/1994 | G02F/1/1335 |
| EP | 0 678 848 A1 * | 10/1995 | |

OTHER PUBLICATIONS

"Fully Integrated Poly–Si TFT CMOS Drivers for Self–Scanned Light Valve", by Y. Nishihara et al, SID Digest, 1992.

"Poly–Si TFT–LCD for HDTV Projectors with a 5–V Fully Integrated Driver", by S. Higashi, SID Digest, 1995.

* cited by examiner

*Primary Examiner*—Richard Hjerpe
*Assistant Examiner*—Henry N. Tran

(57) ABSTRACT

An active matrix liquid crystal display device comprising display elements (10) addressed via sets of row and column address conductors (14, 16) connected respectively to row and column drive circuits (30, 35) and with the column drive circuit (35) being operable to transfer data signals for the display elements of a row to groups of column address conductors (16) in sequence in respective group address periods in a multiplexing manner. The occurrence of undesirable display artifacts is alleviated by applying, during the group address period for one group, a pre-charging signal to the adjacent column address conductor of the next-addressed group according to the level (magnitude) of a data signal for a column conductor in that one group. This can be achieved conveniently by providing, in addition to a multiplexing switch (36) for that adjacent column conductor, a supplementary switch (Tx) connected to a video input line (V1, V2, V3), and which operates simultaneously with the multiplexer switches of the

16 Claims, 6 Drawing Sheets

ACTIVE MATRIX LIQUID CRYSTAL DISPLAY DEVICES

BACKGROUND OF THE INVENTION

The present invention relates to an active matrix liquid crystal display device comprising a row and column array of liquid crystal display elements, each display element having an associated switching device, sets of row and column address conductors connected to the display elements via which selection signals and data signals, respectively, are applied to the display elements, a row drive circuit for applying selection signals to the set of row address conductors and a column drive circuit for applying data signals to the set of column address conductors, which column drive circuit is operable to transfer the data signals for the display elements of a row to groups of column address conductors in sequence, in respective group address periods, each group comprising a plurality of column address conductors.

Active matrix liquid crystal display devices, are well known, typical examples of such, and the general manner in which they operate, are described in U.S. Pat. No. 5,130,829. In these devices, display element electrodes are provided on a first substrate together with the switching devices, in the form of TFTs (thin film transistors), and sets of row and column address conductors. A second substrate carrying a transparent common electrode is arranged spaced from the first substrate and LC (liquid crystal) material is disposed between the two substrates. Each He display element electrode is connected to the drain electrode of its associated TFT. The gates of all of the TFTs in a row of display elements are connected to a respective row address conductor and the source electrodes of all the TFTs in a column of display elements are connected to a respective column address conductor. A row drive circuit connected to the set of row address conductors scans the row conductors by applying a selection (gating) signal to each row conductor in sequence to turn on the TFTs of a row of display elements, and a column drive circuit connected to the set of column conductors applies data signals to the column conductors in synchronism with the scanning of the row conductors by the row drive circuit, whereby the display elements of a selected row are charged via their respective TFTs to a level dependent on the value of the data signal on their associated column conductors to produce a required display output. The rows are driven individually in turn during respective row address periods in this manner so as to build up a display picture over one field period, and the array of display elements is repeatedly addressed in a similar manner in successive field periods.

For convenience of manufacture and compactness, the row and/or column drive circuits in some display devices, and especially those using polysilicon TFTs, have been integrated on the substrate carrying the TFTs peripherally of the display element array using the same large area electronics technology as that employed for the active matrix circuitry of the array with the circuitry of the drive circuits being fabricated simultaneously with this circuitry and similarly comprising TFTs, conductor lines, etc. Due to certain limitations in operational performance of the TFTs and the kinds of circuit possible when using TFTs, the column drive circuit is customarily provided in the form of a simple multiplexing circuit, examples of which are described in U.S. Pat. No. 4,890,101, the paper entitled "Fully Integrated Poly-Si TFT CMOS Drivers for Self-Scanned Light Valve" by Y. Nishihara et al in SID 92 Digest, pages 609–612, and in the paper entitled "A 1.8-in Poly-Si TFT—LCD for HDTV Projectors with a 5-V Fully Integrated Driver" by S. Higashi et al in SID 95 Digest, pages 81 to 84. This type of column drive circuit operates in the manner described in the opening paragraph, the operation being based on a multiplexing technique in which analogue video information (data) is sequentially transferred via multiplexing switches from a plurality of video input lines, to which video information is applied simultaneously, to corresponding groups or blocks of column address conductors in the display with each column conductor in a group being connected via a multiplexer switch to a different video input line. Each column address conductor is connected to a respective output of the circuit and typically in these circuits, the operation is such that an output associated with one column conductor becomes high impedance prior to, or while, the data signal for an adjacent column conductor is applied. During a row address (video line) period the multiplexer circuit operates to charge each group of column conductors in turn until all the column conductors in the display device have been charged to a level corresponding to the level of the video information on the input lines. Once a group of column conductors has been charged the associated multiplexing switches open and the column conductors become high impedance nodes with the voltage applied being maintained on the column conductor capacitance, and then the next group is charged. The circuit operates in this manner so as to charge all the groups in sequence and to drive each row of display elements in turn in this way during respective row address periods.

Whilst the provision of an integrated, multiplexing type, column drive circuit has benefits with regard to the simplication of fabrication of the display device, it has been found that problems can occur in the display output from the display element array during operation of the device. Particularly, certain columns in the array may show errors by virtue of the display elements in these columns having incorrect drive levels which results for example in a lack of display uniformity when displaying uniform grey fields that manifests itself as highly visible vertical lines in the displayed image.

SUMMARY OF THE INVENTION

It is an object of the present invention to provide an active matrix display device of the kind using a column drive circuit which operates in the manner of a multiplexing circuit in which the problem of the aforementioned undesirable display output artefacts is overcome or reduced at least to some extent.

According to the present invention there is provided an active matrix liquid crystal display device of the kind described in the opening paragraph which is characterised in that the column drive circuit is arranged to apply during an address period for one group a pre-charging signal to the adjacent column address conductor of the next-addressed group according to the value of a data signal for a column address conductor in that one group. Such pre-charging of a column conductor in a group at the time the preceding group is being charged is intended to reduce the size of the voltage transition on that column conductor occurring when that column conductor is charged in the subsequent group address period. As a result of this pre-charging, it has been found that the extent of the unwanted display artefacts is considerably reduced.

The invention stems from an appreciation of the reason for these display artefacts when using a multiplexing type of column drive circuit. Capacitive couplings can occur between adjacent column address conductors, either directly or indirectly. Where each column conductor extends between facing edges or sides of an adjacent pair of display element electrodes in a row, capacitance coupling between an adjacent pair of column address conductors indirectly via the electrode can be significant. Direct capacitive coupling between two column conductors can occur in the case of an alternative lay-out in which pairs of column conductors are provided adjacent one another and columns of display element electrodes are provided to either side of the pair, one column of electrodes being addressed via one of column conductors and the other addressed via the second column conductor. The presence of such indirect or direct capacitance means that as the voltage on the first column conductor of one group is changed in operation of the column drive circuit, the change in voltage can be coupled onto the last column conductor of the previously addressed group through this capacitance, thereby disturbing the voltage set on that last column conductor. This results in errors occurring in the voltage on the last column conductor of each group (apart from the last) which errors cause the aforementioned visible vertical lines in the displayed image. The problem is particularly apparent in high aperture type display devices, in which the display element electrodes are carried on an insulating layer that extends over the active matrix circuitry, comprising the TFTs and sets of row and column address conductors, on the substrate and in which portions of the display element electrodes are arranged to overlap partially the two adjacent column address conductor (and row address conductors) so as to increase their effective apertures. Such overlap can result in significant capacitance existing between a column address conductor and the adjacent portions of the display element electrodes.

By pre-charging, in accordance with the invention, the column conductor causing this interference, the magnitude of the voltage transition occurring on that column conductor when subsequently addressed by the column drive circuit is reduced, thereby reducing the error caused on the adjacent column conductor in the prior—addressed group.

For the greatest benefit the column conductor is preferably pre-charged to a value close to its expected final voltage, as dependent on the value of the intended data signal for that column conductor, and the pre-charging is effected in a way such that the voltage transition and the induced error tends to zero for plain fields where the visible effects of the induced error are most significant.

In a preferred embodiment, the data signals are transferred from a plurality of video input lines via multiplexing switches whose outputs are each coupled to a respective column conductor, as in known multiplexing column drive circuits, and the said adjacent column conductor of the next-addressed group is connected to a video input line via a supplementary switch, in addition to its associated multiplexer switch. The supplementary switch is arranged to be operated at the same time as the multiplexer switches of the previously addressed group. The supplementary switch and the multiplexer switch associated with the column conductor preferably are connected to the same video input line. Thus, when that preceding group is selected, the first column conductor in the next group is charged through the supplementary switch to the potential level existing on its associated video line at that time. Thereafter, when the next group is selected the first column conductor of this group is again addressed, via its respective multiplexer switch, and charged to the potential which then exists on the video line, i.e. the intended data signal level. The voltage transition on this first column conductor in the subsequently addressed group then corresponds just to the difference in the potential on its associated video line between successive time periods in which the two groups are selected. In the case of a plain field display, the video line voltage remains constant so the difference will be zero. In some cases, for example when a column inversion drive scheme is employed, it may be desirable to connect the supplementary switch to a video input line different from that to which the multiplexing switch is connected.

BRIEF DESCRIPTION OF THE DRAWINGS

Embodiments of active matrix display devices in accordance with the present invention will now be described, by way of example, with reference to the accompanying drawings, in which.

It will be appreciated that the Figures are not drawn to scale and that certain dimensions may have been exaggerated whilst other dimensions may have been reduced. The same reference numerals are used throughout the Figures to denote the same or similar parts.

DESCRIPTION OF THE PREFERRED EMBODIMENT

Figure 1:
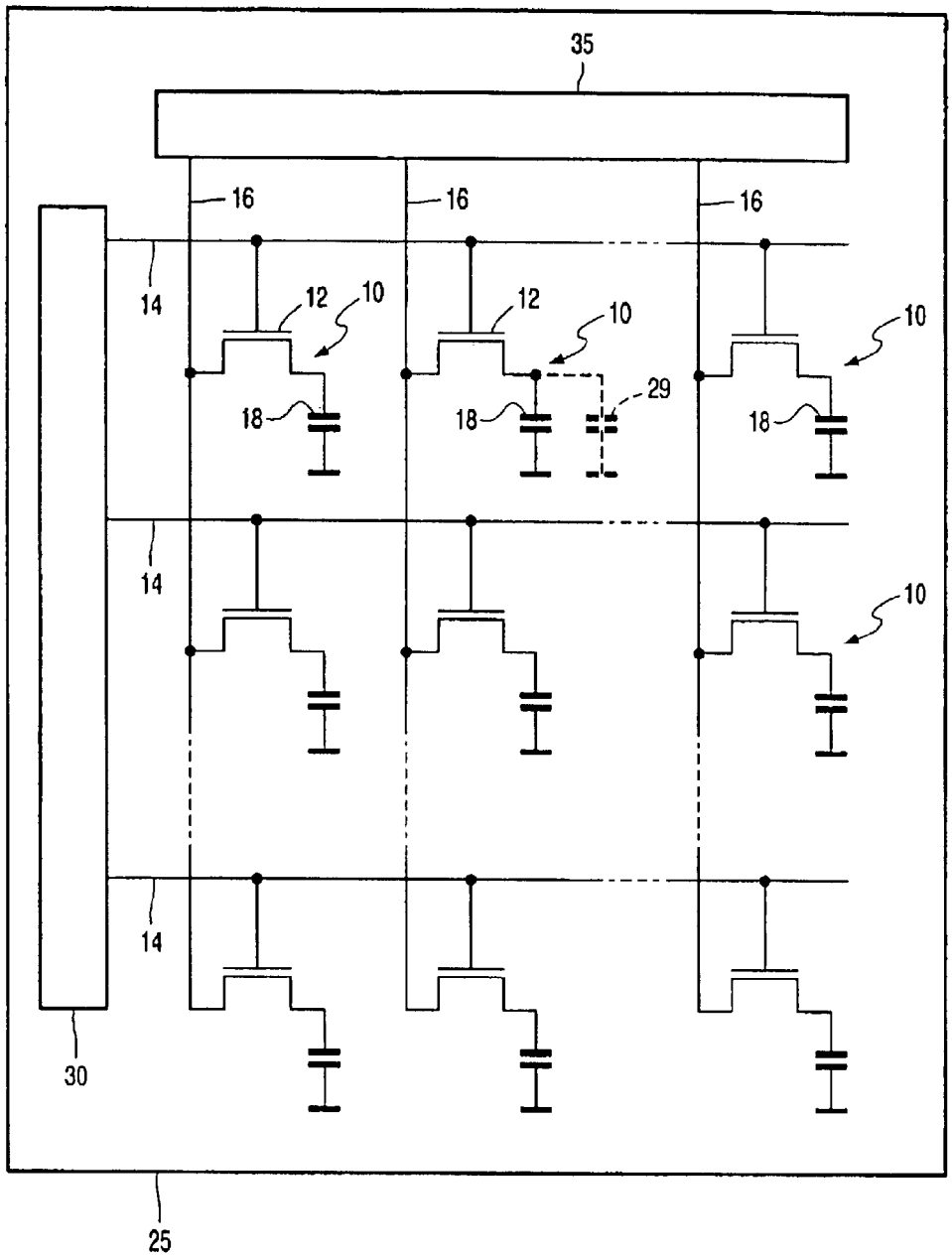
FIG. 1 is a simplified schematic circuit diagram of an active matrix LC display device.

Referring to FIG. 1, a simplified schematic circuit diagram of a generally conventional active matrix liquid crystal display device comprising a row and column array of liquid crystal display elements 10 is shown. The display elements each have an associated TFT 12 acting as a switching device, and are addressed via sets of row and column address conductors 14 and 16. Only a few display elements are shown here for simplicity. In practice there can be several hundred rows and columns of display elements. The drain of a TFT 12 is connected to a respective display element electrode 18 situated adjacent the intersection of respective row and column address conductors, while the gates of all the TFTs associated with a respective row of display elements 10 are connected to the same row address conductor 14 and the sources of all the TFTs associated with a respective column of display elements are connected to the same column address conductor 16. The sets of row and column address conductors 14, 16, the TFTs 12, and the picture element electrodes 18 are all carried on the same insulating substrate, for example of glass, and fabricated using known thin film technology involving the deposition and photolithographic patterning of various conductive, insulating and semiconductive layers. A second glass substrate, (not shown) carrying a continuous transparent electrode common to all display elements in the array is arranged spaced from the substrate 25 and the two substrates are sealed together around the periphery of the display element array and separated by spacers to define an enclosed space in which liquid crystal material is contained. Each display element electrode 18 together with an overlying portion of the common electrode and the liquid crystal material therebetween defines a light-modulating display element.

Both the general structure and operation of this device follow conventional practice, for example as described in U.S. Pat. No. 5,130,829 whose contents are incorporated herein. Scanning (gating) signals are applied to each row address conductor 14 in turn by a row drive circuit 30, comprising for example a digital shift register, and data signals are applied to the column conductors 16, in synchronisation with the gating signals, by a column drive circuit 35. Upon each row conductor being supplied with a gating signal, the TFTs 12 connected to that row conductor are turned on causing the respective display elements to be charged according to the level of the data signal then existing on their associated column conductors. After a row of display elements has been addressed in a respective row address period, corresponding for example to the line period of an applied video signal, their associated TFTs are turned off, upon termination of the gating signal, for the remainder of the field period in order to isolate electrically the display elements and ensure the applied charge is stored on the LC capacitance to maintain their display outputs until they are addressed again in a subsequent field period For a transmissive mode of operation, the display element electrodes 18 are formed of a light transparent conductive material such as ITO and the individual display elements serve to modulate light, which may be directed onto one side of the device, e.g. the substrate 25, from a backlight, according to their applied data signal voltage so that a display image, built up by addressing all the rows of display elements in the array, can be viewed from the other side. For a reflective mode of operation, the display element electrodes 18 are formed of light reflecting conductive material such as a metal, and light entering the front of the device through the substrate carrying the common electrode is modulated by the LC material at each display element and, depending on their display state, reflected by the reflective display element electrodes back through that substrate to generate a display image visible to a viewer at the front of the device.

Figure 2:
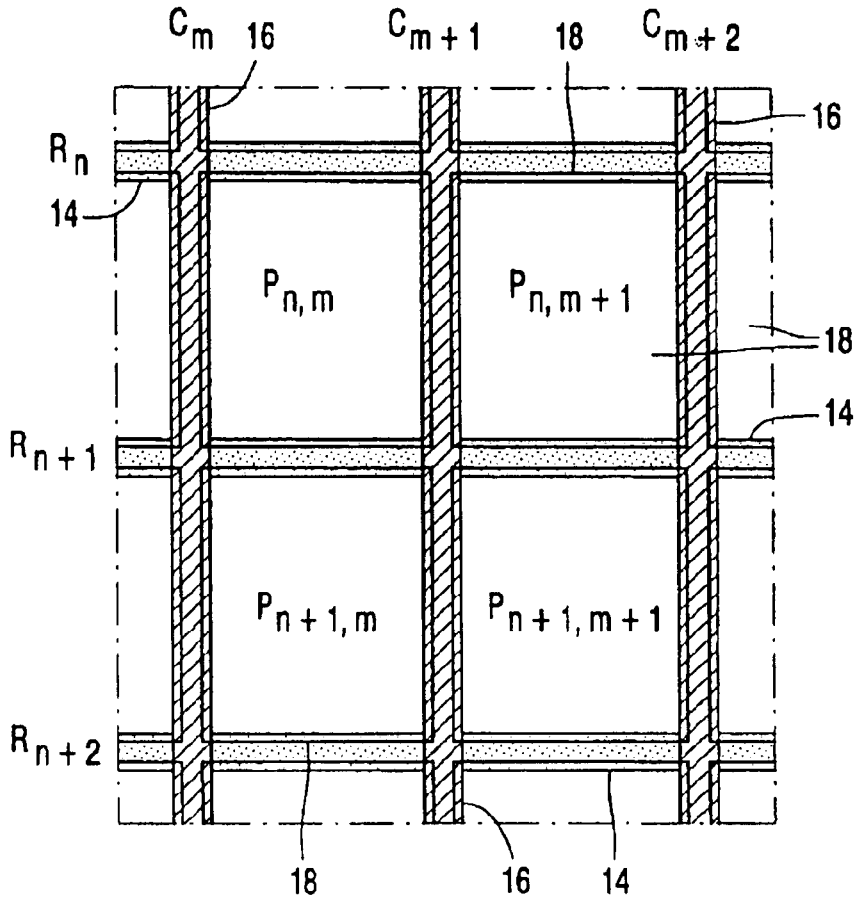
FIG. 2 illustrates schematically the lay-out of the display element electrodes and row and column address conductors in a typical part of a known active matrix LC display device of the high aperture kind.

An example of a typical physical arrangement of the display element electrodes and row and column address conductors in a portion of the array is depicted schematically in FIG. 2. The TFTs 12 are omitted here for the sake of clarity, but are located adjacent the intersection of the row and column conductors associated with the display element concerned. The individual display element electrodes 18 are labelled Pn,m where n and m denote their respective row and column numbers. Thus, the electrode Pn,m is addressed via associated row and column conductors Rn and Cm, the electrode Pn,m+1 is addressed via the row and column conductors Rn and Cm+1, the electrode Pn+1, m is addressed via the row and column conductors Rn+1 and Cm, etc. In this particular example, the display device structure is of the kind providing a high aperture. To this end, the display element electrodes 18 are carried on layer of insulating material, for example of silicon nitride or an organic material such as polyimide or resist, that is disposed over the active matrix circuitry, comprising the sets of address conductors and the TFTs carried on the substrate, and are extended so as to partly overlap at their opposing vertical side edges the adjacent column conductors 16 and at their top and bottom edges the adjacent row conductors 14, as shown in FIG. 2. As will be apparent, therefore, each column conductor is overlapped by portions of the display element electrodes in two adjacent columns of display elements. Each display element electrode 18 is connected to the drain of its associated TFT underlying the insulating layer through a contact opening (not shown) formed in the insulating layer. The individual display element electrodes 18 are separated from their neighbours by a small gap lying over the row and column conductors. Examples of this type of structure are described in U.S. Pat. No. 5,641,974 and EP-A-0617310 to which reference is invited for a more detailed description.

The row and column drive circuits 30 and 35 are for convenience and simplicity integrated on the substrate 25 and fabricated simultaneously with the active matrix array, comprising the TFTs and the sets of row and column address conductors, using the same thin film processing technology. Integrated drive circuits are well known, examples of such being described in the aforementioned papers. Normally polysilicon technology is used, although amorphous silicon technology can be employed instead in certain cases. The integrated column drive circuit 35, is provided in the form of a multiplexing type of circuit. The general operation of such a circuit is based on a multiplexing technique in which analog video information is sequentially transferred from a plurality of video input lines to groups of a corresponding number of the column address conductors in the display device. The video information is transferred via multiplexing switches which may consist of NMOS TFTs, PMOS TFTs or CMOS transmission gates. The switches, which each constitute an output of the circuit associated with a respective column conductor, are operated in groups and when a group of switches is turned on the corresponding columns are charged to the data signal voltage levels then existing on the respective video lines. When the switches turn off, the voltages on the column conductors are stored on the capacitance of the column conductors and any additional storage capacitors which may be connected in parallel with them. During a video line row address period each group of multiplexing switches is turned on in sequence until all of the columns of display elements have been charged with the appropriate video information.

Figure 3:
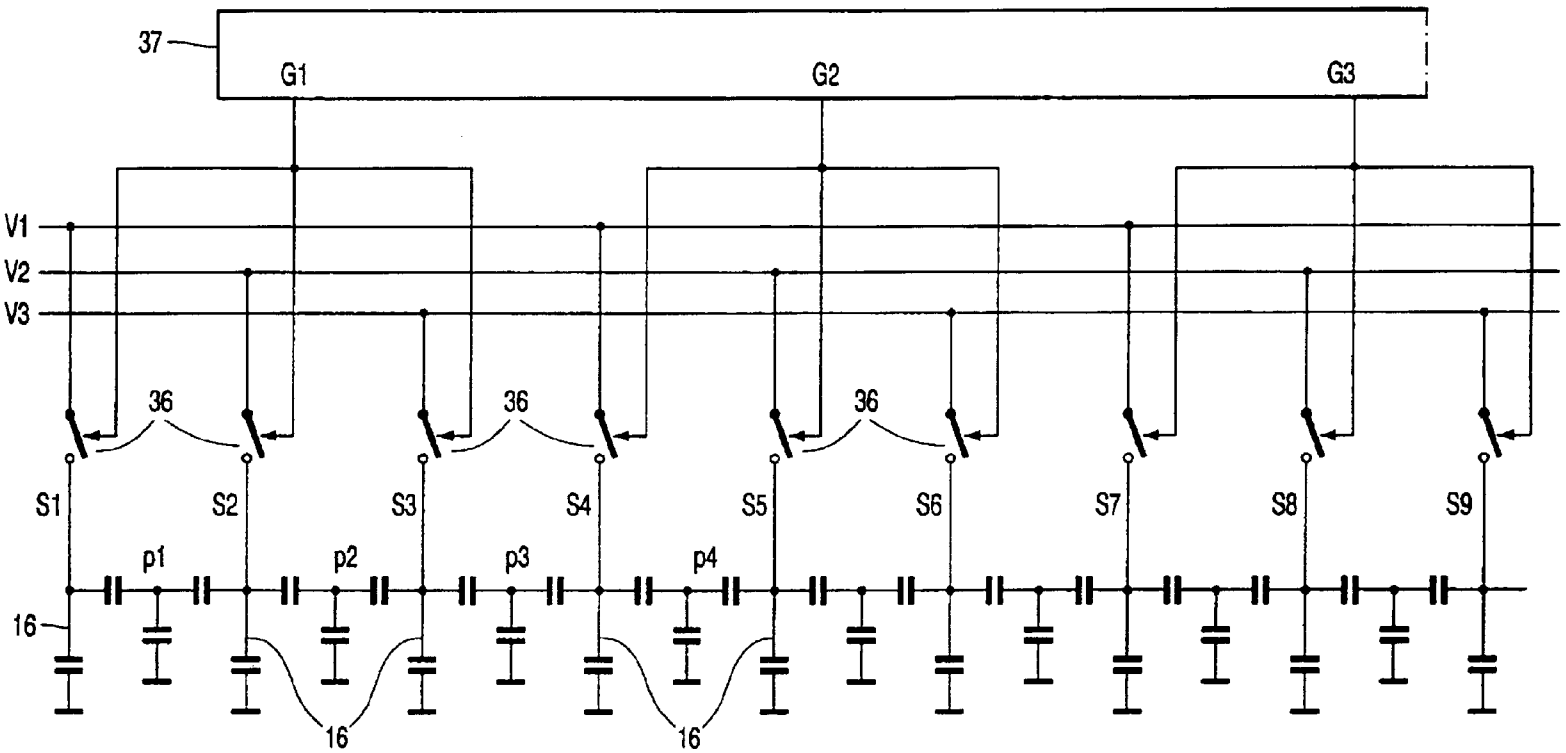
FIG. 3 illustrates schematically a part of a known multiplexing type column drive circuit, together with some column conductors and their associated capacitances.

FIG. 3 illustrates in simplified, schematic, form a part of a known multiplexing column drive circuit 35. In this relatively simple example, there are three video input lines, V1, V2 and V3, to which parallel input video signals are applied, and the multiplexing switches, 36, are arranged in groups of three with their outputs connected to respective consecutive column address conductors 16. A control circuit 37, comprising a shift register, which may or may not be integrated on the substrate 25 with the multiplexing circuit, sequentially selects each of the groups of multiplexing switches using the control signals G1, G2, G3, etc so that at the end of the video line period all of the columns in the array have been charged. When G1 goes high the first three multiplexer switches 36 close and the first three columns S1, S2 and S3 are charged to the voltage level on the video lines V1, V2 and V3 respectively. G1 then goes low, the three multiplexer switches open, and the columns S1, S2 and S3 become isolated from the video lines. The voltage on the columns is then stored on the column capacitance. Next, the control signal G2 goes high, closing the next group of switches 36, and the second group of three columns, S4, S5 and S6, is charged to the voltage then existing on the video lines. The operation of the multiplexing circuit continues in this way with each group of columns being charged appropriately in succession until all the column conductors in the array have been charged.

In the operation of display devices using a multiplexing column drive circuit, problems have been experienced with display artifacts occurring in the form of visible vertical lines at regular intervals. It has been determined that these artifacts are caused by voltages being unintentionally capacitively coupled onto particular column conductors in the operation of the column drive circuit which result in an error in the voltages of the display elements associated with those column conductors and hence their output brightness. Such capacitive couplings arise due to the fact that the column address conductors 16 extend adjacent to columns of display element electrodes 18. As a consequence, significant capacitance exists between a column address conductor and the adjacent display element electrodes. This is particularly the case in a high aperture type of display element lay-out in which the display element electrodes partially overlie the column conductors.

Figure 4:
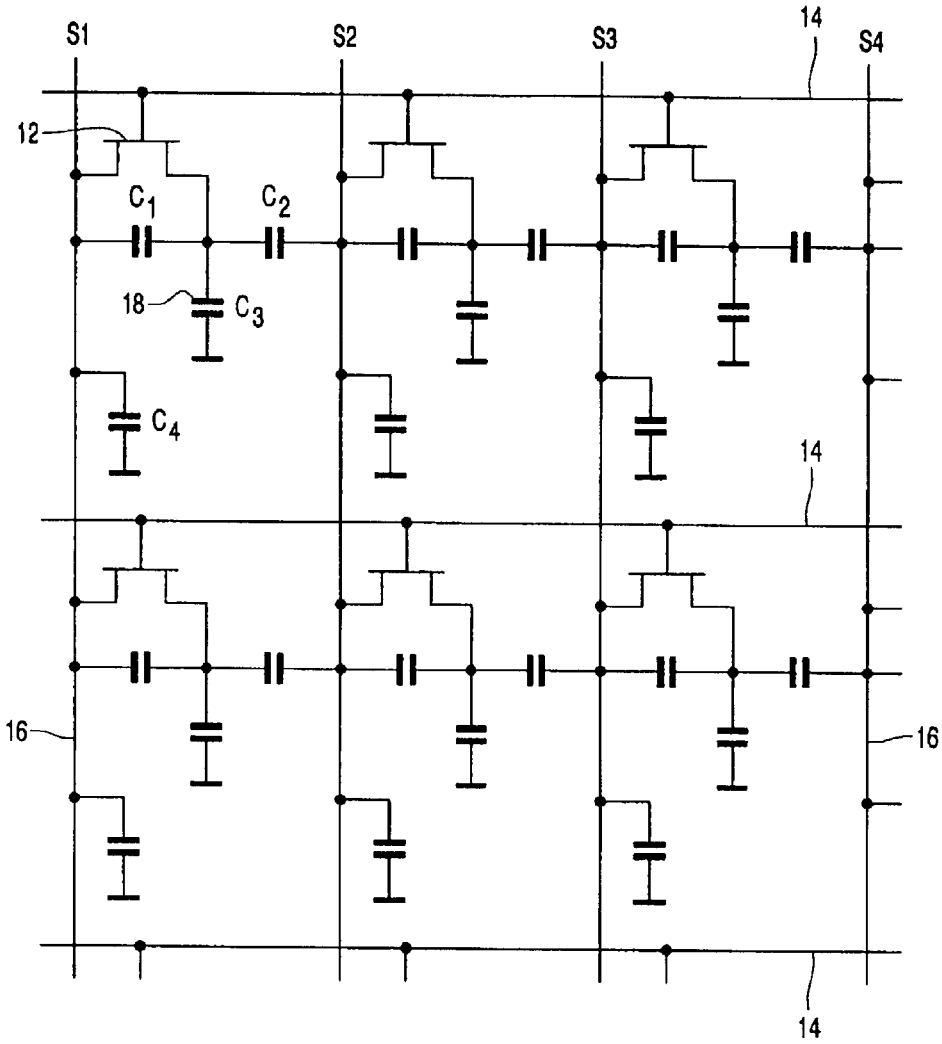
FIG. 4 shows the equivalent circuit of a part of the display element array of the display device of FIG. 1.
Figure 5:
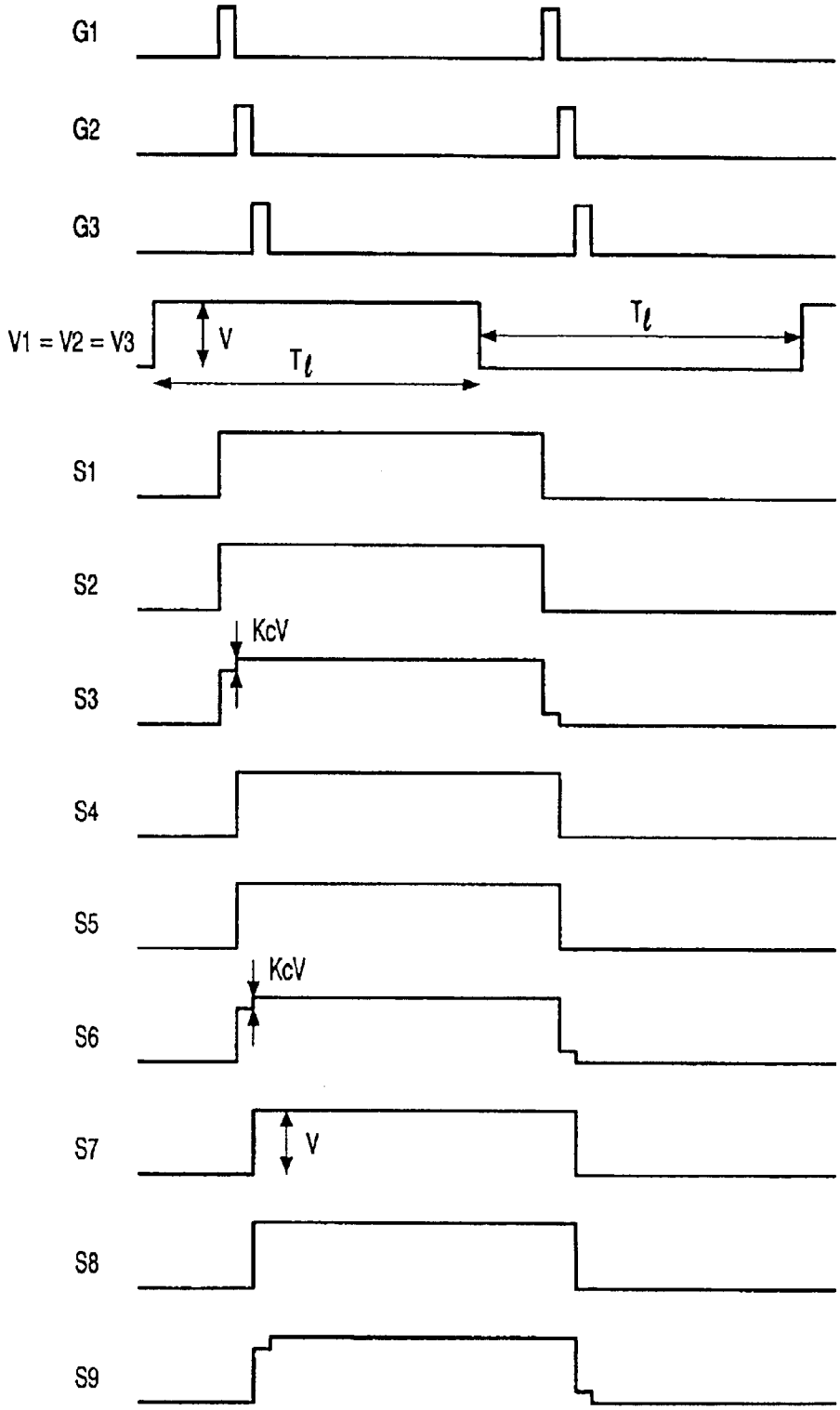
FIG. 5 illustrates typical drive waveforms present in operation of the display device.

This effect will be described with reference also to FIG. 4 which shows an approximate equivalent circuit for a typical small number of display elements in the array, and to FIG. 5 which illustrates examples of certain voltage waveforms in operation of the circuit of FIG. 3. The display elements of the display device each contain a number of capacitances, some of which are shown in FIG. 4. $C_1$ and $C_2$ represent the capacitance between display element electrode 18 and the two adjacent column conductors 16. $C_3$ represents the display element capacitance, which may be a combination of the liquid crystal capacitance and a display element storage capacitor. $C_4$ represents the capacitance of the column conductor and will include the capacitance between the column conductor and the row conductor and the capacitance between the column conductor and the common electrode of the display array and the gate—source capacitances of the TFTs. Other capacitances may also be present and may contribute to the effects described here but have been omitted for clarity.

The source of the column voltage errors will become apparent by considering the effect of a change in the video information on, for example, column conductor S2. This change in voltage is coupled onto the display element capacitor $C_3$ via capacitor $C_2$ and therefore causes a change in the display element voltage. If the voltage on column conductor Si is not being maintained by the column drive circuit, i.e. the relevant column drive circuit output becomes high impedance and column conductor Si is floating, then this change in display element voltage can be further coupled onto the column conductor S1 via the capacitor $C_1$. This coupling of a change in voltage on one column conductor onto an adjacent column conductor can be denoted by a coupling factor Kc. If the voltage on the first column conductor changes by an amount $\Delta V$, then the change in voltage that this produces on the second column conductor is given by $Kc\Delta V$. This effect will be further explained with reference also to FIGS. 3 and 5. It is assumed here for simplicity that the display array is being addressed with a uniform grey field, and that row inversion, as well as field inversion of the polarity of the video information drive voltage is used, and also that the column drive circuit 35 has just three video input lines. Similar effects will occur for other inversion methods, for circuits with different numbers of video lines and when the displayed video information is more complex. In FIG. 5, G1, G2 and G3 are the control waveforms applied to the first three groups of multiplexer switches 36 which include voltage signals for turning on these switches, and S1 to S9 are the voltage waveforms appearing on the first nine column conductors. As the display is showing a uniform grey field, the voltage waveforms applied to the three video lines, V1 to V3, are the same, as signified in FIG. 5. The polarity of the video signals inverts after each video line period (TI). The control circuit 37 within the column drive circuit sequentially selects each of the groups using the control signals G1, G2, G3, etc so that at the end of the video line period TI all of the columns in the display have been charged. When G1 goes high the first group of three column conductors S1, S2 and S3 is charged to the voltage level on the respective video lines. When the second group is selected immediately thereafter by G2 going high then as the voltage on column conductor S4 changes this change is coupled, with reduced amplitude, onto the display element electrodes of the display elements in the third column, represented by the node p3 in FIG. 3. The change in display element voltage is further coupled onto the last column conductor, S3, in the previously addressed group since this conductor is now isolated from the video lines. This results in an error in the column voltage as indicated in the voltage waveform for S3 in FIG. 5. The voltage change is also coupled further to column conductor S2 via the display element node p2 and then to column conductor S1 via node p1. However, at each stage of coupling the magnitude of the coupled signal is reduced by the factor Kc. It is therefore the error in the voltage on S3 which is of the most importance to the uniformity of the displayed image.

Once the second group of three columns has been charged the signal G2 goes low and the second set of multiplexer switches turns off. When the third group of columns is charged by G3 going high, coupling of the change in voltage on column conductor S7 causes an error in the voltage on column conductor S6. This effect occurs in a similar way for each group of columns in the array so that in general the last, or end, column in each multiplexer group will be subject to a significant voltage error due to the voltage change on the adjacent column conductor in the next group, i.e. the first column conductor in the subsequently selected group. This error, which is a kind of cross-talk, manifests itself in the form of vertical lines being visible in the displayed image, the pitch of the lines corresponding to the width of the multiplexer groups.

In order to avoid, or significantly reduce, the visibility of such errors, the first column in one group is pre-charged before the group concerned is actually selected by the control signal associated with that group going high and during the period in which the immediately preceding group, in terms of selection order, is selected. The pre-charging is such as to minimise the amplitude of the voltage transition on the first column of that group, and hence the amplitude of the error voltage capacitively coupled onto the last, end, column of the preceding group, i.e. the group selected immediately before. In particular, the error voltage is reduced at least close to zero in plain areas of the display image where the brightness is not varying, and which are the parts of the image where the error is most highly visible. Desirably, the column is pre-charged to a value close to its expected final voltage, as determined by the value of the data signal intended for that column.

Figure 6:
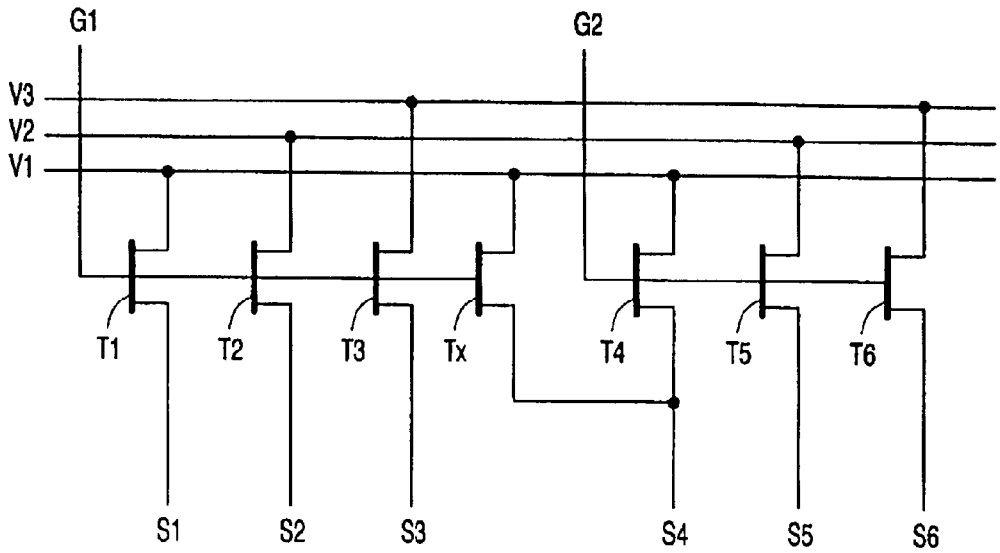
FIG. 6 shows schematically a part of the column drive circuit of an embodiment of a display device according to the present invention.

FIG. 6 shows schematically part of the column drive circuit in a preferred embodiment of display device according to the present invention for achieving this objective. The part of the circuit shown comprises two adjacent multiplexer groups, each again coupled to three successive column conductors. The six multiplexer switches 36, comprising TFTs, are labelled T1 to T6. TFTs T1 to T3 are the multiplexer switches of a first multiplexer group operable by a control signal G1 and TFTs T4 to T6 are the multiplexer switches of the succeeding, i.e. next-addressed, multiplexer group operable by the control signal G2. In this circuit, an additional switch, again in the form of a TFT, is connected between the first column conductor in each group, (apart from that of the first group in the sequence), and the appropriate video line in parallel with the multiplexer switch associated with that column conductor. Thus, referring to FIG. 6, a supplementary TFT, Tx, is connected in parallel with the TFT T4 between the column S4 and the video line V1. Unlike, the multiplexer switch T4 (and also T5 and T6) which is operated by the control signal G2 applied to its gate, the gate of the supplementary TFT Tx is connected to the control line carrying the control signal G1 and hence is operable simultaneously with the TFTs T1 to T3 of the preceding group. Each multiplexer group, apart from the first, has a supplementary TFT connected in this way so that, in general, the first column conductor in the Nth group has a supplementary TFT connected thereto which is operable by means of a control signal for the $(N-1)^{th}$ group.

Figure 7:
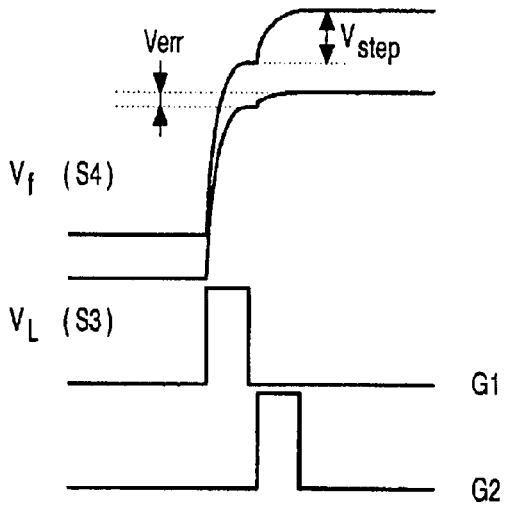
FIG. 7 illustrates an example of column voltage and control signal waveforms in operation.

The operation of the column drive circuit 35 in respect of these two groups is illustrated in FIG. 7 in which Vf and VI represent respectively the voltage appearing on the first column of one group, e.g. the column S4 in the $(N+1)^{th}$ group, and the voltage on the last column of the preceding group, e.g. the column S3 in the $N^{th}$ group. These two column voltage waveforms are shown offset vertically in FIG. 7 for the sake of clarity. When the selection signal for the first group, i.e. the $N^{th}$ group, is active (i.e. the control signal G1 for that group goes high), all the columns of the $N^{th}$ group, S1 to S3, are charged to their appropriate data signal levels on the video lines V1 to V3 via the TFTs T1 to T3 respectively. Thus, V1, (S3), increases to a certain value according to the level on V3. Simultaneously, the first column, S4, of the next, $(N+1)^{th}$ group is also charged to the potential of the video line V1 via the TFT Tx so that Vf, (S4), also rises during this period. When this next, $(N+1)^{th}$, group is immediately thereafter selected by G2 going high, the voltage transition on the first column S4 now only corresponds to the difference in the potential on the video line V1 between the adjacent time periods corresponding to the selection periods of the control signals G1 and G2. The change in Vf in this period, Vstep, and the voltage error, Verr, consequently induced on the column S3 are minimised.

In a plain field, where the effects of any errors in the column voltages would be most noticeable, the video line voltages, determined by the video signal applied to the column drive circuit 35, will be constant and so the first column of block N+1, i.e. S4, is charged to the correct voltage via Tx. Thus, the voltage step, Vstep, will be zero and likewise the error voltage, Verr, will be zero. In other cases, where there is a change in voltage on the relevant video line, then Vstep will not actually be zero. However, it will be smaller than the step corresponding to the full transition from a positive signal to a negative signal and, because it is in an area of the picture where there is a horizontal gradation in image brightness, the remaining small error will not be visible. The overall effect is that the size of Vstep, and hence the size of Verr, is proportional to the difference in voltage between the last column in the $N^{th}$ group and the first column in the $(N+1)^{th}$ group. As this same voltage determines the difference in brightness in display elements in a horizontal direction, the effect of the error will be invisible as it is small where the brightness changes little and only large where there is a large brightness change which will hide the error.

The arrangement shown in FIG. 6 is suited to the case where the display is driven in any mode where the polarity of the video signal on the input video lines does not change during the line period. This is always the case if the display is driven in a field or row (line) inversion mode and in some implementations of pixel and column inversion. However, if the display is driven in column or pixel inversion with the inversion applied by periodically inverting the incoming video signals on each input video line, then the TFT, Tx, needs to be connected to a different video line to the arrangement shown in FIG. 6. The reason can be seen by considering the arrangement of FIG. 6. If along a given row, column S1 is, for example, to be charged positive, column 32 negative, column S3 positive etc, then the polarity of the video line V1 will be positive during the G1 group select period but negative during the G2 group select period. This means that column S4 would be pre-charged to the wrong polarity (positive) during the G1 group select. This will produce a large voltage transition on column S4 when group G2 is selected (and charged negative) giving the same undesirable high level of coupling onto column S3 as would occur if Tx were not present. The solution in such a cases is to connect the extra TFT, Tx, to one of the video lines which has the same polarity during the G1 group select period as V1 has during the G2 group select period. In this case, this can be achieved by connecting it to video line V2.

In a colour display device, colour filter elements are carried on the other substrate in conventional manner and in this case the video input lines V1, V2 and V3 may each carry a respective colour, red, green and blue, video information component with adjacent columns in the array being arranged to display red, green and blue information.

While the invention has been described in relation to a kind of display device structure in which the display element electrodes are carried above the active matrix circuitry on an insulating layer in particular, it is applicable to other types of display structures in which the electrodes 18 are situated at a similar level to, and laterally of, the TFTs and sets of addressed conductors, for example of the kind described in U.S. Pat. No. 5,130,829.

The part of the column drive circuit 35 which supplies the video signal to the video input lines (e.g. V1, V2 and V3) and the control circuit 37 which applies control signals, G1, G2, G3, etc to the multiplexer switches need not be integrated on the substrate 25 but instead may be formed separately and connected to the multiplexing circuit on the substrate.

Moreover, while it is particularly convenient for at least the multiplexing circuit of the column drive circuit to be fully integrated on the same substrate as the active matrix circuitry, this part of the drive circuit, and likewise the row drive circuit, could be fabricated as a separate component and electrically interconnected with the active matrix circuitry, for example, using chip-on-glass technology.

It is envisaged that the invention can be used beneficially in display devices using column drive circuits other than of the multiplexing type but which likewise operate in such a way that an output associated with one column conductor becomes high impedance before or while an adjacent column conductor is being supplied with a data signal as similar problems would be experienced.

From reading the present disclosure, other modifications will be apparent to persons skilled in the art. Such modifications may involve other features which are already known in the field of active matrix liquid crystal display devices and component parts thereof and which may be used instead of or in addition to features already described herein.

What is claimed is:

1. An active matrix liquid crystal display device comprising: a row and column array of liquid crystal display elements, each display element having an associated switching device, sets of row and column address conductors connected to the display elements via which selection signals and data signals, respectively, are applied to the display elements, a row drive circuit for applying selection signals to the set of row address conductors and a column drive circuit for applying data signals to the set of column address conductors, which column drive circuit is operable to transfer the data signals for the display elements of a row to groups of column address conductors in sequence, in respective group address periods, each group comprising a plurality of column address conductors, characterized in that the column drive circuit is arranged to apply, during an address period for one group, a pre-charging signal to the adjacent column address conductor of the next-addressed group of a level dependent upon the level of a data signal for a column address conductor in that one group.

2. An active matrix display device according to claim 1, characterised in that the data signals for a row are transferred from a plurality of video input lines via multiplexing switches whose outputs are each coupled to a respective column address conductor, and in that said adjacent column address conductor of the next-addressed group is connected to a video input line via a supplementary switch, in addition to its associated multiplexer switch, wherein the supplementary switch is operated at the same time as the multiplexer switches of the previously addressed group.

3. An active matrix display device according to claim 2, characterised in that the associated multiplexer switch and the supplementary switch associated with said adjacent column address conductor are connected to the same video input line.

4. An active matrix display device according to claim 2 or claim 3, characterised in that the switching devices of the display elements and the multiplexing switches comprise thin film transistors fabricated on a common substrate.

5. An active matrix display device according to claim 1, characterized in that the switching devices of the display elements and the sets of row and column address conductors are provided on a substrate and covered by a layer of insulating material which carries display element electrodes.

6. An active matrix display device as claimed in claim 1 further comprising a plurality of multiplexing switches sequentially operatable in groups to couple the data signals to respective column address conductors, a plurality of supplementary switches, one for each group of column address conductors, with a supplementary switch of any group of column address conductors coupled in parallel with a multiplexing switch of that group of column address conductors, and means for operating each supplementary switch simultaneously with the operation of the multiplexing switches of the preceding group of column address conductors.

7. An active matrix display device as claimed in claim 6 wherein the multiplexing switches and the supplementary switches all comprise transistors.

8. The active matrix liquid crystal display device as claimed in claim 1 wherein the column drive circuit comprises multiplexer switching means coupling data input lines to respective column address conductors, and the pre-charging signal is applied to the adjacent column address conductor during the address period of the one group so as to vary the pre-charging signal dependent upon the level of a data signal present on at least one data input line.

9. The active matrix liquid crystal display device as claimed in claim 1 wherein the pre-charging signal applied to the adjacent column address conductor by the column drive circuit attains at least first and second different positive levels for respective different associated positive data signals and at least first and second different negative levels for respective different associated negative data signals, each of said positive and negative levels being dependent upon the respective levels of their associated data signals.

10. The active matrix liquid crystal display device as claimed in claim 1 wherein the level of the pre-charging signal is equal to the level of the data signal for the column address conductor in said one group.

11. An active matrix liquid crystal display device having parasitic capacitances associated therewith that couple unwanted voltage changes between certain column conductors of different groups of column conductors, and which produce undesirable display artifacts in the liquid crystal display device, the display device comprising:

a row and column array of liquid crystal display elements with each display element coupled to an associated switching device, an array of row and column address conductors connected to the display elements via which selection signals and data signals, respectively, are applied to the display elements, a row drive circuit for applying selection signals to the row address conductors and a column drive circuit for applying data signals in sequence to groups of column address conductors, each group comprising a plurality of column address conductors, and means for reducing the display artifacts which comprises, means including the column drive circuit for applying, during an address period for one group of column address conductors, a pre-charging signal to an adjacent column address conductor of the next-addressed group of a level determined by the magnitude of a data signal for a column address conductor in that one group of column address conductors.

12. The active matrix liquid crystal display device as claimed in claim 11 wherein the column drive circuit comprises a multiplexing column drive circuit including multiplex switching means, and the pre-charging signal is applied to the adjacent column address conductor via a single supplemental switch for each group of column address conductors, wherein each supplementary switch is operated at the same time as the multiplexer switching means of the previously addressed group.

13. The active matrix liquid crystal display device as claimed in claim 11 wherein the column drive circuit comprises multiplexer switching means and a single supplementary switch for each group of column address conductors via which the data signals and the pre-charging signal are applied to the column address conductors.

14. The active matrix liquid crystal display device as claimed in claim 11 wherein the column drive circuit comprises:

multiplexer switches coupling data input lines group-wise to respective column address conductors, means for selectively coupling a certain data input line to respective ones of the adjacent column address conductors of the groups of column address conductors, and means for synchronizing operation of the multiplexer switches and the selective coupling means.

15. The active matrix liquid crystal display device as claimed in claim 14 wherein the selective coupling means comprises supplementary switches, and there are fewer supplementary switches than multiplexer switches.

16. The active matrix liquid crystal display device as claimed in claim 11 wherein the level of the pre-charging signal is not a function of the polarity of the data signal on the column address conductor.

* * * * *